US007959481B1

(12) United States Patent
Wayne

(10) Patent No.: US 7,959,481 B1
(45) Date of Patent: Jun. 14, 2011

(54) TOWED-SPORTS HANDLE SAFETY DEVICE

(76) Inventor: Thomas Wayne, Anchorage, AK (US)

( * ) Notice: Subject to any disclaimer, the term of this patent is extended or adjusted under 35 U.S.C. 154(b) by 0 days.

(21) Appl. No.: 12/387,908

(22) Filed: May 7, 2009

Related U.S. Application Data

(60) Provisional application No. 61/127,187, filed on May 9, 2008.

(51) Int. Cl.
*B63B 35/85* (2006.01)

(52) U.S. Cl. ..... 441/69

(58) Field of Classification Search ..... 114/69; D21/777, 801; 441/69
See application file for complete search history.

(56) References Cited

U.S. PATENT DOCUMENTS 5,628,083 A * 5/1997 Hayes ..... 15/244.3
2006/0118452 A1 * 6/2006 Gattefosse et al. ..... 206/531
* cited by examiner

*Primary Examiner* — Stephen Avila

(57) ABSTRACT

A safety device for a tow handle such as might be used for waterskiing, wakeboarding, kite-boarding, etc. One embodiment of the safety device provides a thin, flat panel (30) made of semi-rigid material and having pressure relief holes (32) and attachment holes (31). In addition, a handle attachment link (34) attaches said panel to the cross bar (41) of the tow handle providing additional support. Other embodiments are described and shown.

4 Claims, 7 Drawing Sheets

TOWED-SPORTS HANDLE SAFETY DEVICE

CROSS-REFERENCE TO RELATED APPLICATIONS

This application claims the benefit of provisional patent application Ser. No. 61/127,187, filed 2008 May 9 by the present inventor.

FEDERALLY SPONSORED RESEARCH

Not Applicable

SEQUENCE LISTING OR PROGRAM

Not Applicable

BACKGROUND

1. Field of Invention

This invention relates to tow rope handles used in various sporting activities in which a person is pulled at the end of a rope.

2. Prior Art

In various sports in which a person is towed behind a watercraft, such as water skiing, wakeboarding, knee boarding and similar sports, the person must typically hold onto a special handle attached to the end of a rope, cable, or other such flexible connection to the tow vehicle. Similar handles are used for sports in which a participant is towed over snow or dry land, or when a participant is towed by a wind-borne kite or parachute-like device. The tow handles used for all of these types of sports bear a striking similarity, in that they are usually comprised of a rigid bar attached to a main towline by means of a V-shaped bridle. A typical towed-sports handle assembly 40 is comprised of a tow handle cross bar 41 attached to two side ropes 42 which converge to a splice knot 43 joining them to a single mainline 44 (FIG. 2). This common configuration allows an opening for the participant to grip the tow handle with one or both hands while maintaining a direct, in-line link to the towing force.

Unfortunately this common V-shaped bridle presents a constant danger to the participant, in that it creates an easy opening into which the participant can accidentally engage a limb during a fall. Historically, the forward momentum of the towing force combined with the trapping nature of such accidental engagement has often resulted in serious injury or death to the participant. Annual safety reports worldwide suggest that such accidents occur as frequently as several dozen times per year, resulting in injuries serious enough to require a visit to an Emergency Room.

Prior to the present invention there has been no device patented that resolves or successfully addresses this danger. There have been some homemade, non-patented attempts that are known to have been tried, and there have been various informal suggestions proposed among waterskiers and participants in other towed sports.

Chief among these is the addition of a piece of fabric being used to cover some portion of the opening of towed-sports handle assemblies. For example, one skier in California reportedly fabricated a triangular canvas sleeve 10 (FIG. 1) designed to fit over the V-shaped area of the handle assembly, thereby enclosing a portion of the dangerous opening. Another skier reportedly sewed a fabric panel directly to the side ropes of the bridle, accomplishing a similar result. There are also apocryphal accounts of skiers wrapping duct tape across the handle opening, or attaching vinyl sheeting material in place. All of these solutions, while seeming adequate in theory, fail in actual use. Commonly, the broad surface-like nature of such devices becomes, effectively, a rudder in the water and a sail in the air. Typically the forces involved in the towed sport result in a premature failure of such homespun devices, rendering them useless. Additionally, when involved in the types of falls that can result in body-part-through-handle injuries, such soft flexible sheets can act as a sort of funnel, guiding the skier's arm (for example) directly into the dangerous opening.

Another device proposed by a skiers is a standard V-shaped handle assembly with an additional spliced-in cross rope 21 (FIG. 2) permanently connected between the two side ropes, parallel to handle cross bar 41, leaving enough space for the skier's hands to grasp the handle. The purpose of this additional rope piece is to prevent a participant's head from entering the handle opening, but it does nothing to address the more common danger of accidentally engaging other body parts, such as the participant's arm. Indeed, this device may well be more dangerous than no safety device at all, in that the additional rope piece can easily create a more serious entanglement when the skier does engage a hand or arm into the opening during a fall.

SUMMARY

In accordance with one embodiment my tow handle safety device comprises an improved safety panel and method by which it can be attached to a tow handle assembly, thereby reducing the opening through which an arm of other body part can be accidentally inserted during a fall.

DRAWINGS

REFERENCE NUMERALS

Figure 1:
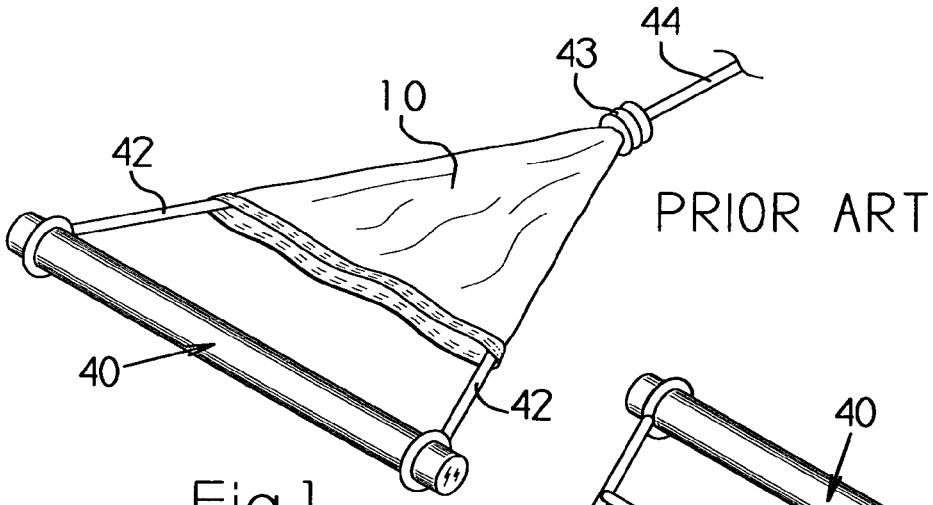
FIG. 1 shows prior art comprised of a triangular canvas sleeve encasing a traditional V-shaped tow handle bridle.

10 triangular fabric sleeve
21 spliced-in cross rope
30 safety panel
31 side rope attachment hole
32 pressure relief hole
33 handle attachment link hole
34 handle attachment link
35 plastic cable tie
40 towed-sports handle assembly

41 tow handle cross bar
42 tow handle side rope
43 tow handle splice knot
44 tow handle mainline
51 fabric hook-and-loop attachment strips
61 tubular attachment members

DETAILED DESCRIPTION

Figure 3:
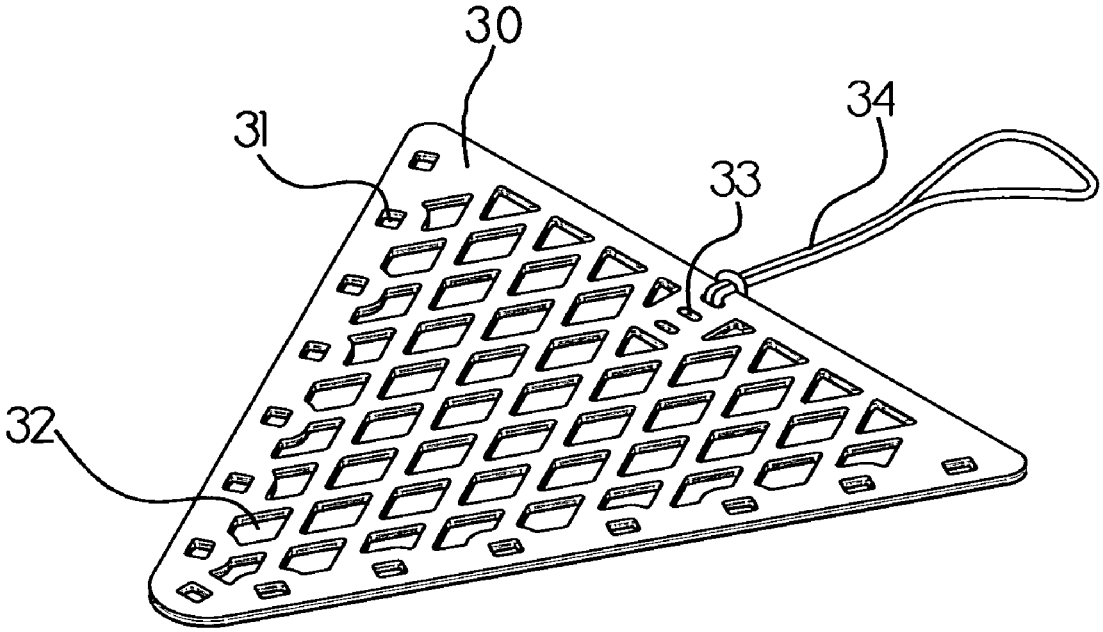
FIG. 3 shows one embodiment of the safety panel with the handle attachment link in place.
Figure 4:
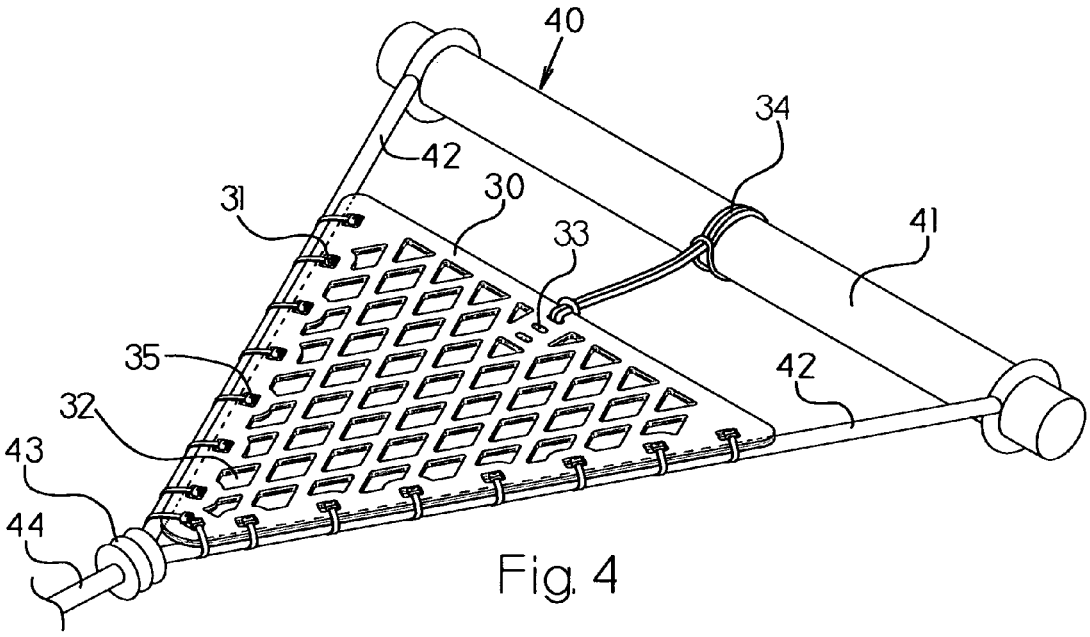
FIG. 4 shows a typical V-shaped tow handle bridle with the attached safety panel in accordance with one embodiment of my device.
Figure 5:
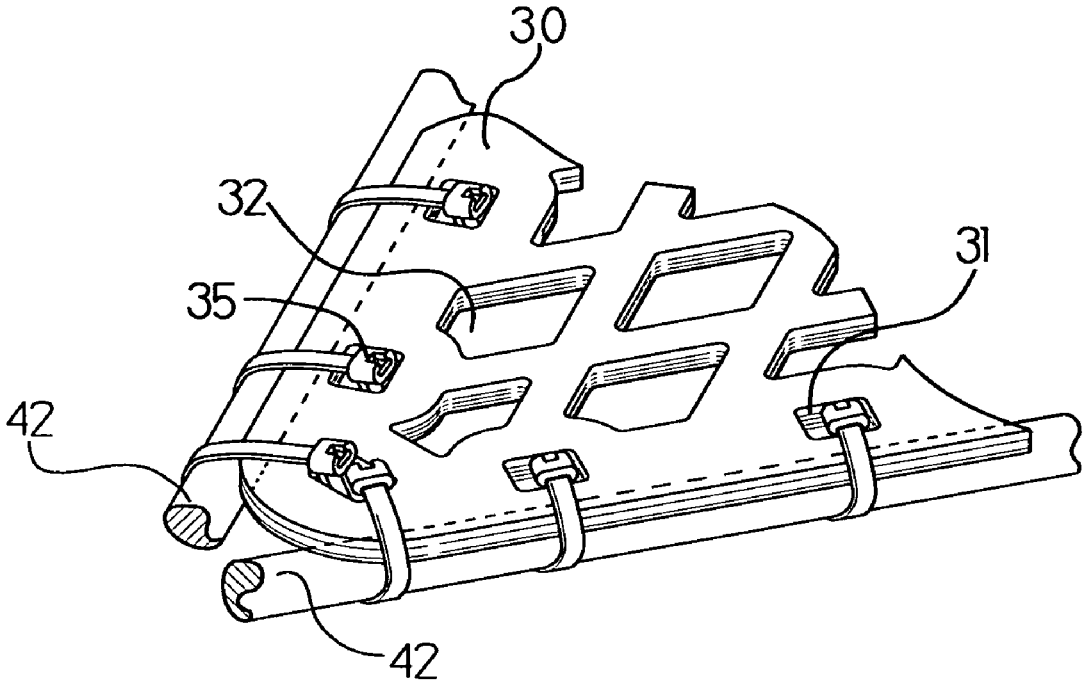
FIG. 5 shows a close view of one method of attaching the safety panel to a standard water sports handle using commercially available plastic wire ties.

First Embodiment—FIGS. 3, 4 and 5

Figure 2:
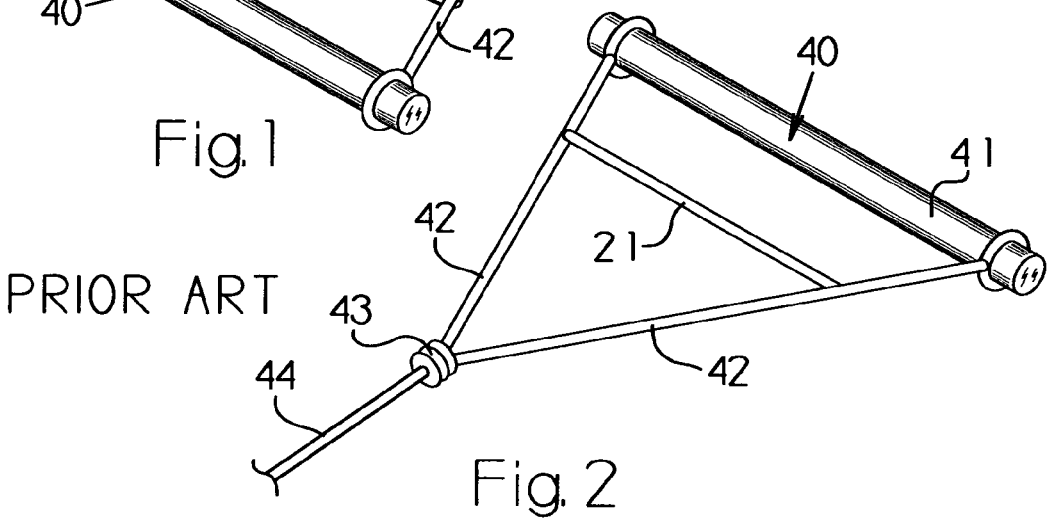
FIG. 2 shows prior art comprised of a typical V-shaped tow handle bridle having an additional rope section spliced across the opening.

One embodiment of the towed-sports handle safety device is illustrated in FIG. 1 , FIG. 2 and FIG. 3. This device has a safety panel 30 of uniform cross section made of semi-rigid material which can be repeatedly flexed without fracturing. In one contemplated embodiment the panel is a semi-rigid plastic, such as polycarbonate. However, the panel can be made of any other semi-rigid material that can be flexed repeatedly without fracturing, such as polyethylene, polypropylene, vinyl, nylon, rubber, various impregnated or laminated fibrous materials, various plasticized materials, etc.

In FIG. 3 and FIG. 5 an elastic center tie member 34 is attached to safety panel 30 through one or more of handle attachment link attachments holes 33. In one embodiment handle attachment link 34 is a cylindrically endless ring of elastic material, such as a copolymer of butadiene and acrylonitrile (commonly know as Buna-N) as can be found in a typical O-ring. However, this member can be made of any other elastic material that can be repeatedly stretched and relaxed without suffering permanent distortion, such as vinyl, rubber, latex, etc. Attachment holes 33 can be whatever size or shape is appropriate for a specific handle attachment link.

In FIG. 3, FIG. 4 and FIG. 5, one embodiment of safety panel 30 has a plurality of side rope attachment holes 31 spaced adjacent to and aligned with the side edges of the safety panel 30. These side attachment holes 31 can be whatever size or shape is appropriate for a specific attachment method.

In FIG. 3, FIG. 4 and FIG. 5, one embodiment of safety panel 30 also has a plurality of pressure relief holes 32. These pressure relief holes can be arranged in whatever configuration, size and shape is most effective for their intended purpose.

OPERATION

Figure 8:
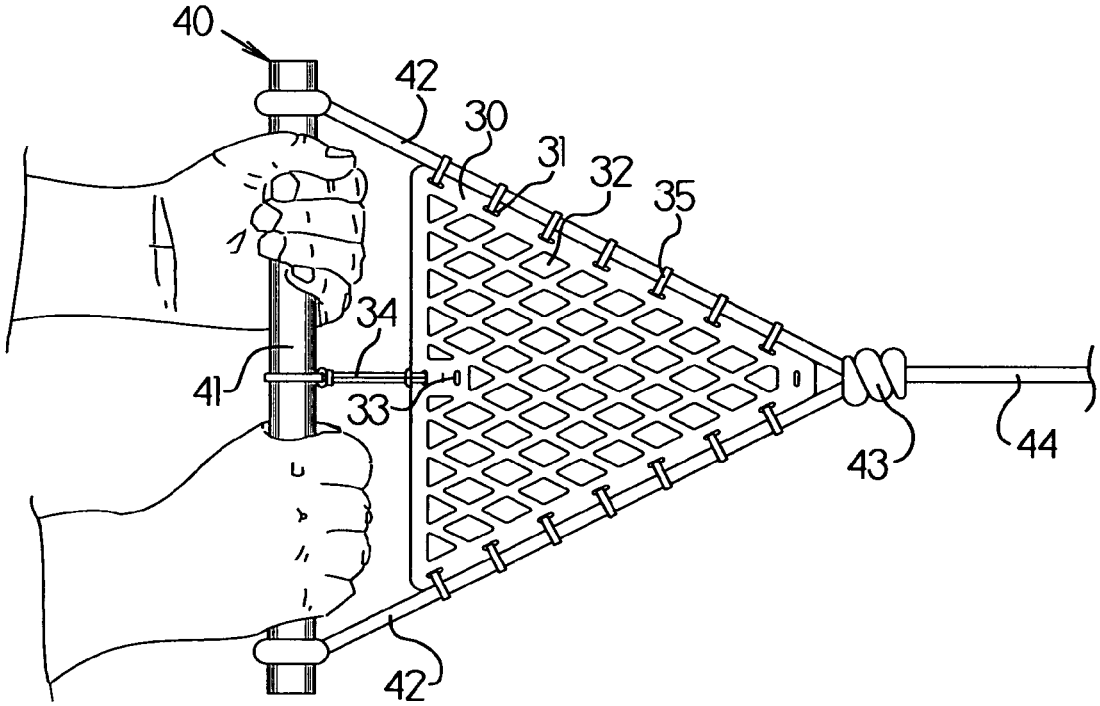
FIG. 8 shows one embodiment as it is used for towed sports.

First Embodiment—FIGS. 4, 5 and 8

The manner of using the towed-sports handle safety device is illustrated in FIG. 4, FIG. 5 and FIG. 8. Safety panel 30 is attached to a commonly available to towed-sports handle assembly 40 in such a way that the panel blocks a large portion of the opening framed by tow handle side ropes 42 and tow handle cross bar 41. Safety panel 30 reduces the likelihood of the towed participant unintentionally thrusting a body part through this opening during an accidental fall.

Because the material that safety panel 30 is constructed from is semi-rigid it is less able to fold into a funnel-like shape during use. This has been a common failing of previous panels made of fabric or other soft materials.

Handle attachment link 34 creates additional blockage of the tow handle assembly's opening, and also provides a supportive connection between safety panel 30 and cross bar 41. In addition to further reducing the tow handle assembly's opening, this supportive connection also limits the amount that safety panel 30 can flex away from cross bar 41. By limiting this flex, safety panel 30 is further prevented from forming into a funnel-like shape that could unintentionally guide the towed sports participant's hand, arm or other body part into the tow handle opening.

In one embodiment of the handle safety device, a method for attaching safety panel 30 to side ropes 42 is illustrated in FIGS. 4, 5, and 8. This attachment method utilizes commonly known commercially available plastic cable ties 35 to bind safety panel 30 to side ropes 42 of handle assembly 40. FIG. 5 shows a closer view of cable ties 35. In practice cable ties 35 would be put in place and then cinched to grip side ropes 42 securely. Alternately safety panel 30 could be attached to side ropes 42 using cord, elastic bands, hook-and-loop straps or mechanical fasteners made of plastic, metal or other similarly appropriate materials. I contemplate the attachment method being somewhat permanent in nature, but able to allow safety panel 30 to break away from handle assembly 40 in the unexpected presence of enough force that such separation would be desirable.

In one embodiment of the handle safety device illustrated in FIGS. 3, 4, and 8, a method for attaching handle attachment link 34 is shown, in which the tie member is simply bound or tied around cross bar 41. This method of attachment is simple and direct but I contemplate other methods, such as utilizing a connecting fastener. Such a fastener can be a commercially available plastic cable tie 35, cord, elastic bands, hook-and-loop straps or mechanical fasteners made of plastic, metal or other similarly appropriate materials.

Because of the features detailed in the above embodiment this tow handle safety device it is superior to all the known tow handle safety devices that preceded it.

DESCRIPTION

Figure 6:
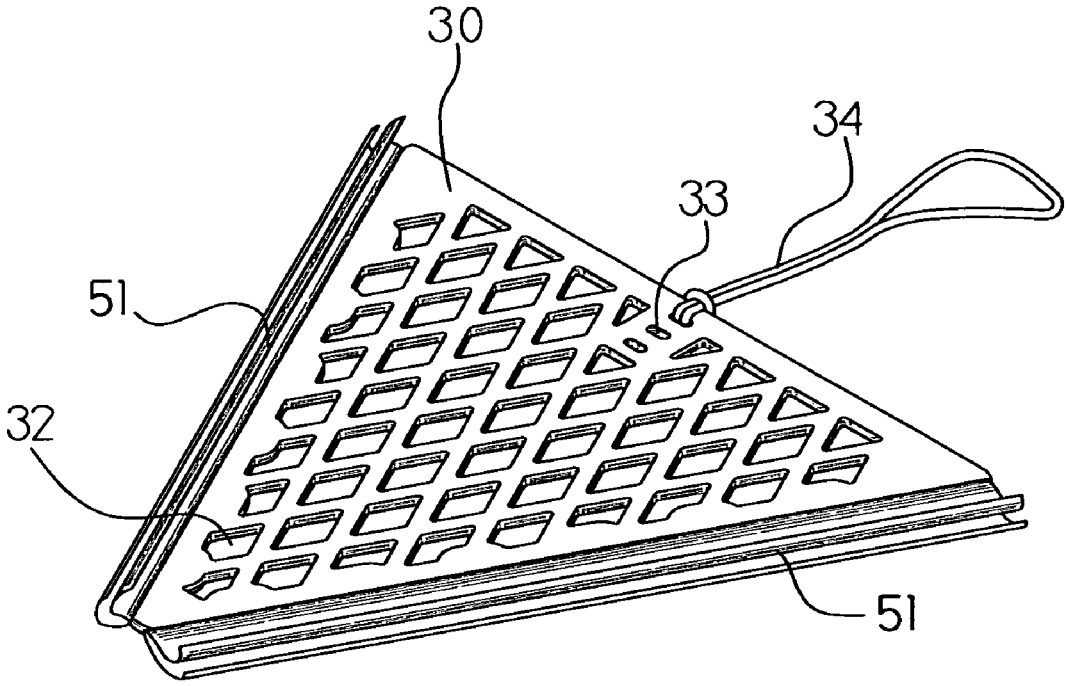
FIG. 6 shows a different method of attaching the safety panel to a standard water sports handle by means of hook-and-loop fastener material.

Alternate Embodiment—FIG. 6

One embodiment of the handle safety device is illustrated in FIG. 6, wherein the method of attaching safety panel 30 to handle assembly 40 (FIG. 4) is two sets of fabric hook-and-loop attachment strips 51. These attachment strips are paired, with one strip having a surfaced faced with male hook-and-loop material and the adjacent strip having a surface faced with male hook-and-loop material. One pair of these male/female strips is permanently bonded to each of the two side edges of safety panel 30, such that they can encompass each side rope 42 (FIG. 4) of handle assembly 40 (FIG. 4). This embodiment is otherwise similar to the device detailed in the first embodiment above, having a safety panel 30 of uniform cross section made of semi-rigid sheet material which can be repeatedly flexed without fracturing. This embodiment also has handle attachment link 34 attached to safety panel 30 through one or more attachments hole 33. Furthermore, this embodiment also has a plurality of pressure relief holes 32 formed into safety panel 30. These holes can be arranged in whatever configuration, size and shape is most effective for their intended purpose.

OPERATION

Alternate Embodiment—FIG. 6

This embodiment exhibits all of the qualities and advantages explained in the first embodiment above and also enjoys the characteristic of being easily removed and reattached at will. I contemplate that this feature would allow a towed sports participant to move the handle safety device from one handle assembly to another as he or she see fit.

DESCRIPTION

Figure 7:
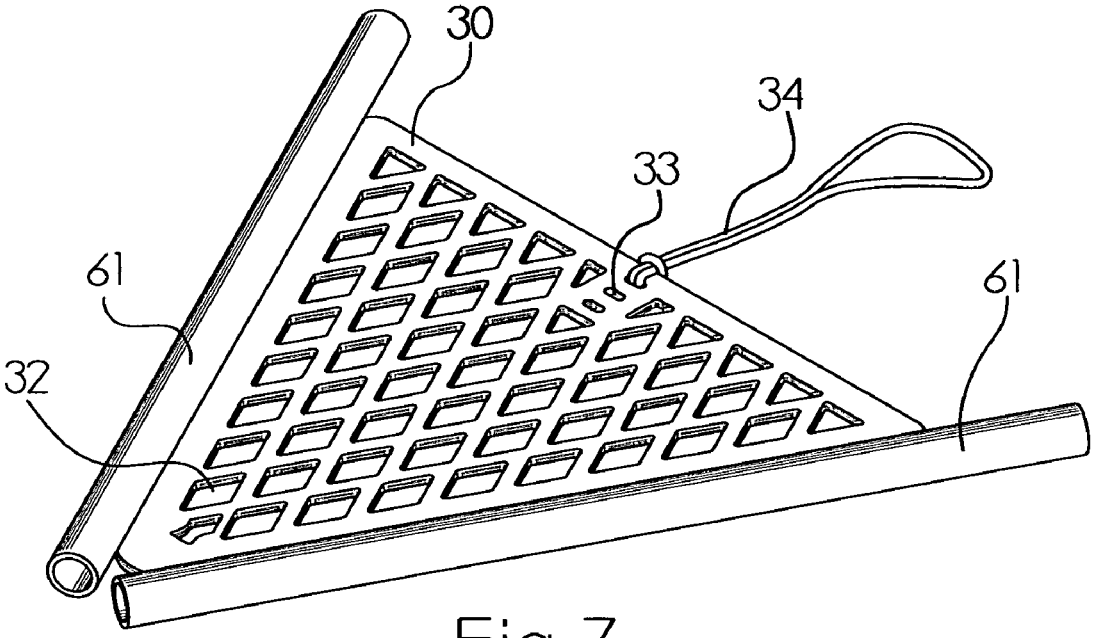
FIG. 7 shows a different method of attaching the safety panel to a standard water sports handle by means of permanently affixed tubular guides.

Alternate Embodiment—FIG. 7

In another embodiment, illustrated in FIG. 7, safety panel 30 is attached to handle assembly 40 (FIG. 4) with a pair of tubular attachment members 61. I contemplate these tubular members being made of a flexible tubing material, such as vinyl. However, the tubular members can be made of any other weather-proof material that can be flexed repeatedly without fracturing, such as polyethylene, polypropylene, vinyl, nylon, rubber, leather, various impregnated or laminated fibrous materials, various plasticized materials, etc. These tubular members are permanently bonded to each of the two side edges of safety panel 30, such that side ropes 42 (FIG. 4) of handle assembly 40 (FIG. 4) can be inserted through the tubular members during the initial manufacturing process of the handle assembly, thus making safety panel 30 an integral part of the entire towed-sports handle.

This embodiment is other wise similar to the device detailed in the first embodiment above, having safety panel 30 of uniform cross section made of semi-rigid sheet material which can be repeatedly flexed without fracturing. This embodiment also has handle attachment link 34 attached to safety panel 30 through one or more attachment holes 33. Furthermore, this embodiment also has a plurality of pressure relief holes 32 formed into safety panel 30. These holes can be arranged in whatever configuration, size and shape is most effective for their intended purpose.

OPERATION

Alternate Embodiment—FIG. 7

This embodiment exhibits all of the qualities and advantages explained in the first embodiment above but is also suitable for Original Equipment Manufacturers ("OEM"). I contemplate that this feature would allow towed-sports handle manufacturing the ability to offer a complete tow handle assembly that would include all of the safety features this embodiment of my handle safety device provides.

CONCLUSION, RAMIFICATIONS, AND SCOPE OF INVENTION

Accordingly, the reader will see that towed-sports handle safety device of the various embodiments is a vast improvement over previous devices, and will provide an increased level of safety to the participant in any towed sport. Furthermore, at least one embodiment of the handle safety device offers additional advantages in that

- it is easily attached to existing tow handle assemblies;
- it is durable and able to withstand the forces and conditions common to towed sports;
- it does not interfere with the normal operation of the towed-sport handle, allowing the participant to engage in towed sport without undue encumbrance.

While the description above contains many specifications, these should not be construed as limiting the scope of the embodiment but as merely providing illustrations of some of the presently preferred embodiments. For example, the safety panel and handle attachment link can be fabricated from other material not listed; the safety panel can have other shapes, such as circular, oval, etc.; the safety panel can be used without a handle attachment link, or with multiple handle attachment links; the safety panel can be comprised of multiple smaller panels articulated together or independent from one another; etc.

Thus the scope of the invention should be determined not by the embodiment(s) illustrated, but by the appended claims and their legal equivalents.

I claim:

1. A safety device for a towed-sports handle assembly, comprising:

(a) a rigid tow handle cross bar with two ends, and (b) a tow handle main line, and (c) two tow handle side ropes with two ends with the side ropes being joined together at the tow handle main line at one end and at the other end the tow handle side ropes being joined to either end of the rigid tow handle cross bar to form a V shaped opening, and (d) a semi-rigid triangular panel of predetermined thickness having opposed major faces and of sufficient size to block some portion of the opening in said towed-sports handle assembly, and (e) said semi-rigid panel having a plurality of pressure relief holes penetrating through said major faces to allow air to pass from one side of the panel to the other, and (f) means for attaching extending along two sides of the triangular panel to couple the semi-rigid panel to the side ropes to attach the panel adjacent to said towed sports handle assembly so as to block some portion V shaped opening.

2. The safety device of claim 1 wherein a handle attachment link is attached between said semi-rigid panel and the cross bar so as to couple the panel to the cross bar.

3. The safety device of claim 1 wherein said semi-rigid panel has a plurality of attachment holes along some of said semi-rigid panel's edges appropriate to the configuration of said towed-sports handle assembly.

4. The safety device of claim 1 wherein said semi-rigid panel has a plurality of tubular attachment elements joined to or integral of said semi-rigid panel along some of said semi-rigid panel's edges appropriate to the configuration of said towed-sports handle assembly.

* * * * *